United States Patent [19]

Bucolt

[11] Patent Number: 4,736,571

[45] Date of Patent: Apr. 12, 1988

[54] ENVELOPE STACKER

[76] Inventor: Charles P. Bucolt, 4850 N. Lake Dr., Whitefish Bay, Wis. 53217

[21] Appl. No.: 2,721

[22] Filed: Jan. 13, 1987

[51] Int. Cl.[4] ..... B65B 35/30

[52] U.S. Cl. ..... 53/501; 53/540; 414/46; 414/47

[58] Field of Search ..... 53/501, 540; 414/46, 414/47

[56] References Cited

U.S. PATENT DOCUMENTS

| | | | |
|---|---|---|---|
| 3,425,184 | 2/1969 | Heliot | 53/501 |
| 3,672,118 | 6/1972 | DeJone | 53/501 |
| 3,729,895 | 5/1973 | Kramer | 53/501 |
| 3,752,063 | 8/1973 | Rapparlie | 414/47 |
| 4,137,604 | 2/1979 | Sanberg | 53/540 X |
| 4,518,300 | 5/1985 | Kent | 414/46 |

*Primary Examiner*—John Sipos
*Attorney, Agent, or Firm*—Ronald E. Barry

[57] ABSTRACT

An envelope stacking apparatus adapted to be positioned at the end of a discharge conveyor for an envelope insertion machine, the apparatus including an infeed conveyor for picking up envelopes from the discharge conveyor, a stacking assembly for stacking envelopes, the stacking assembly including a stacking conveyor and a pusher plate, a transfer conveyor for transferring the envelope stacks from the stacking assembly, a drive mechanism for driving the infeed conveyor and transfer conveyor continuously, the drive mechanism including a one-revolution clutch for intermittently actuating the stacking conveyor and a counter for tripping the clutch when a predetermined number of envelopes have been stacked in the stacker assembly.

4 Claims, 2 Drawing Sheets

ENVELOPE STACKER

BACKGROUND OF THE INVENTION

Envelope insertion or stuffing machines are used for inserting stacks of advertising material into envelopes. The individual inserts are moved from respective insert bins onto a conveyor which is advanced in a step-by-step manner to form insert stacks. The insert stacks are moved from the stepping conveyor onto a stuffing station. Envelopes are fed from an envelope bin onto the stuffing station where a stuffing mechanism opens the envelopes and feeds the insert stacks into the open envelopes. The stuffed envelopes are collected, labeled, stacked and generally bundled in numbered stacks according to zip code numbers. The operator must check the envelopes to verify the end of a zip code and the beginning of a new zip code on the envelopes.

SUMMARY OF THE INVENTION

The envelope stacking apparatus, according to the present invention, can be quickly and easily positioned at the discharge end of an envelope stuffing station in a position to pick up the envelopes as they are discharged from the insertion machine. The stacking apparatus can be programmed to either stack the envelopes in predetermined numbers in each stack, as well as separating the envelope stacks according to zip code. The stacking apparatus is independently operated and is designed to be used as an independent unit which can be placed at the end of any standard envelope stuffing machine. Stuffed envelopes are stacked and accurately aligned at a stacking assembly which includes an intermittently actuated conveyor. The conveyor is activated on signal when the stack reaches the required number or the zip code changes. The envelopes are then pushed onto a transfer conveyor for delivery to a bundling or packing station.

DETAILED DESCRIPTION OF THE INVENTION

Figure 1:
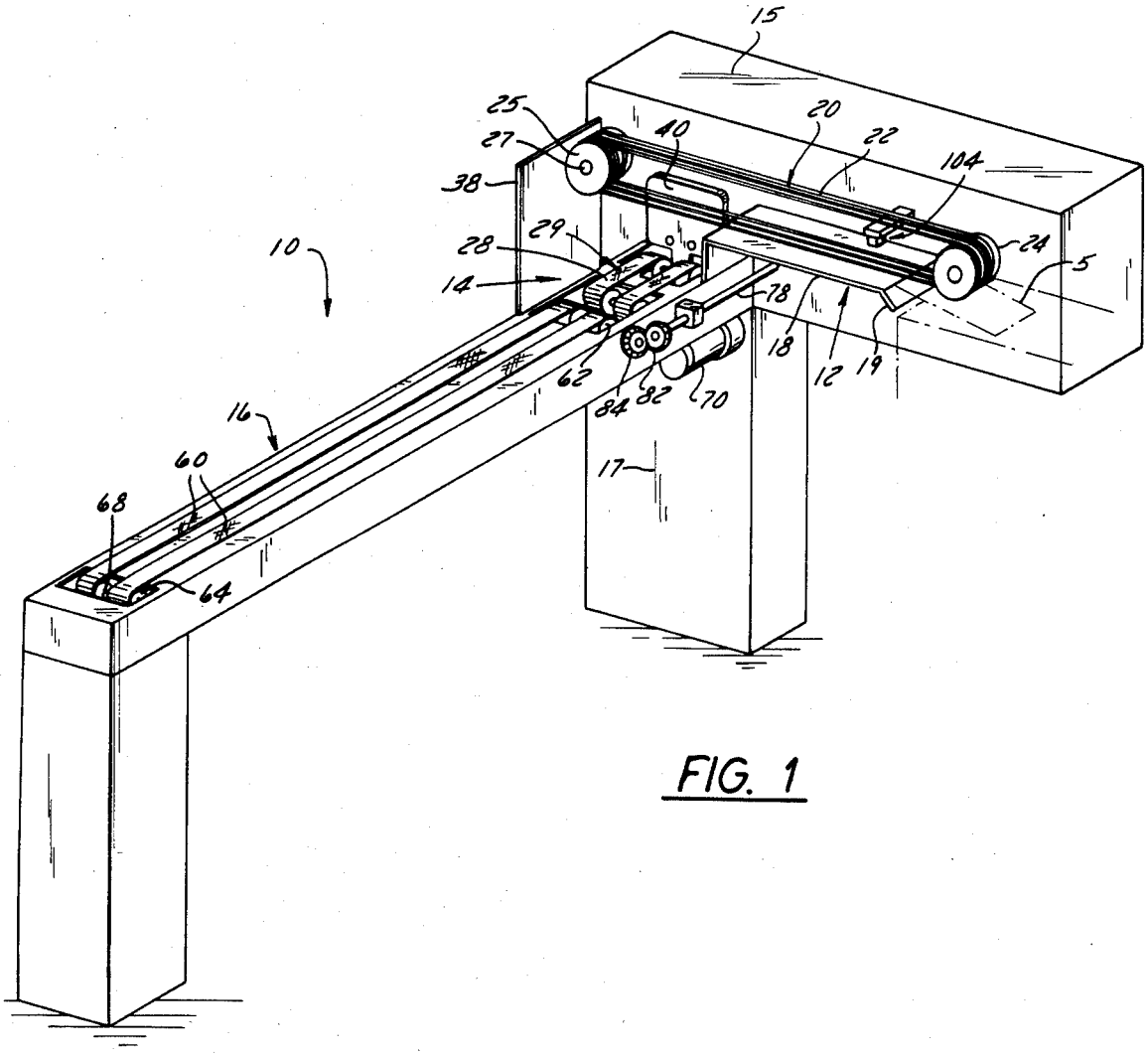
FIG. 1 is a perspective view of the stacking apparatus, according to the present invention.
Figure 2:
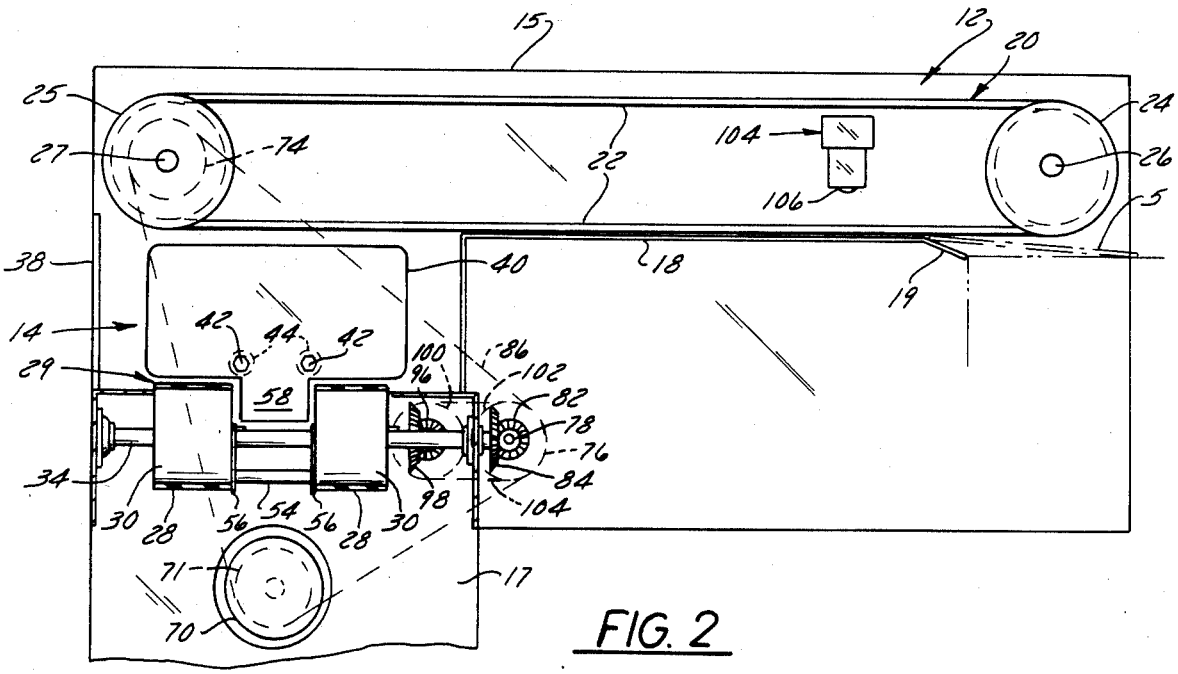
FIG. 2 is a side elevation view in section showing the in-feed conveyor and the stacking assembly.
Figure 3:
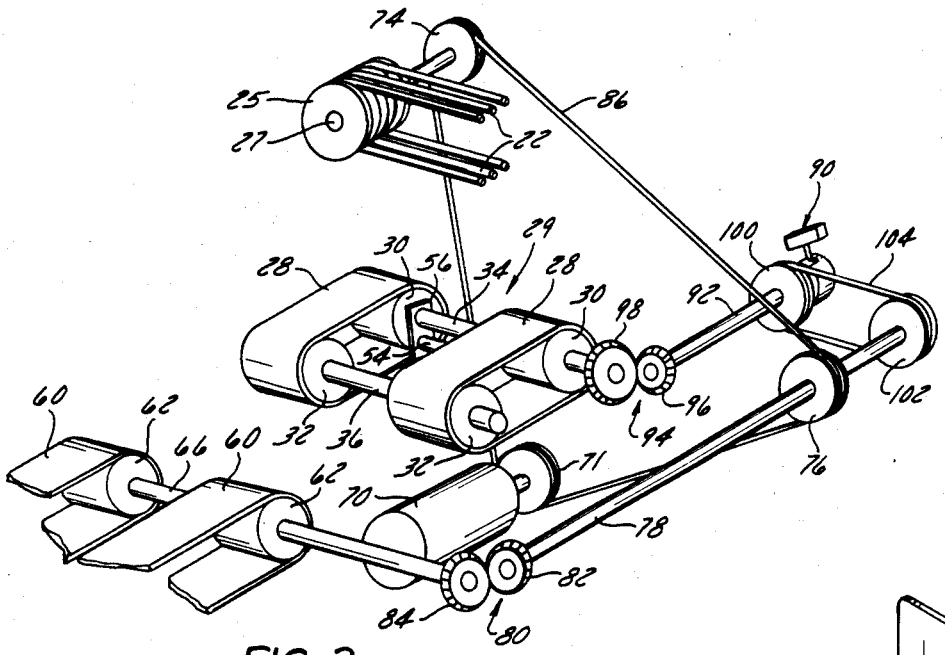
FIG. 3 is a perspective view of the drive system for the conveyors.
Figure 6:
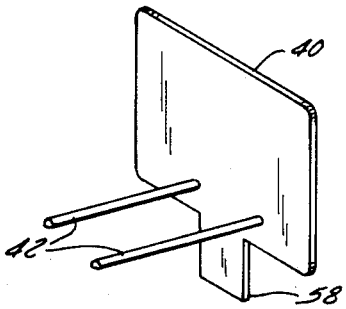
FIG. 6 is a perspective view of the pusher plate.
Figure 4:
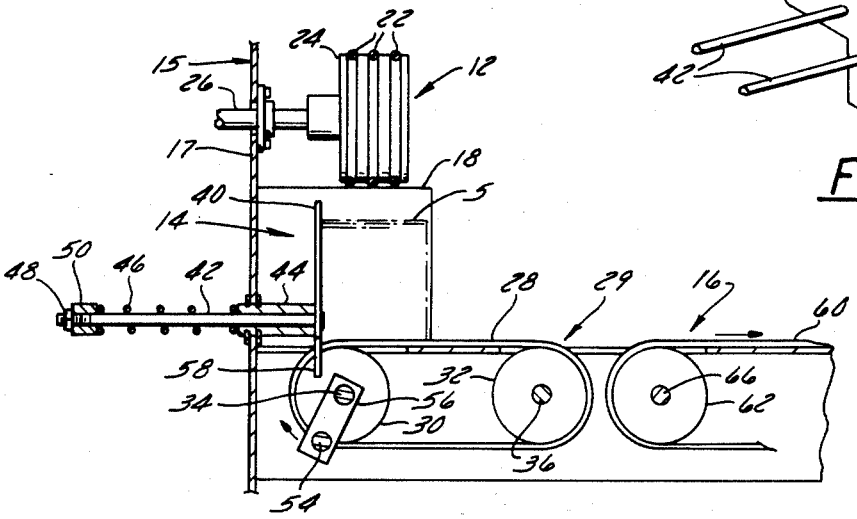
FIG. 4 is a side elevation view partly broken away showing the pusher plate, and conveyor for the stacking assembly.

The envelope stacking apparatus 10, according to the present invention, generally includes a housing 15 having mounted thereon a first means in the form of an in-feed conveyor assembly 12 for transporting envelopes from the stuffing station, a second means in the form of a stacking assembly 14 for receiving, aligning and ejecting envelope stacks and a third means in the form of a transfer conveyor assembly 16 for transporting the stacked envelopes from the apparatus. Stuffed envelopes 5 are picked up from an insertion machine by the in-feed conveyor assembly 12 and fed to the stacking assembly 14. The envelopes 5 are stacked in the stacking assembly and, on signal, are discharged from the stacking assembly onto the transfer conveyor assembly for delivery to a bundling station.

The in-feed conveyor assembly 12 includes means in the form of a plate 18 having a guide lip 19 for guiding the envelopes 5 into engagement with a belt conveyor assembly 20. The belt conveyor assembly 20 includes a number of elastic belts 22 mounted on a pair of cylindrical rollers 24 and 25. The roller 24 is mounted on an idler shaft 26 and the roller 25 is mounted on a drive shaft 27 having a drive pulley 74 on the outer end. Envelopes which are fed onto the plate 18 will, engage the lip 19 which guides the lead edge of the envelopes into engagement with the belts 22. The belts 22 will draw the envelopes across the plate 18 for discharge into the stacking assembly 14.

The stacking assembly 14 includes a conveyor assembly 29 which is mounted in a Perpendicular relation to the direction of motion of the in-feed conveyor 12. The conveyor assembly 29 includes a pair of conveyor belts 28 mounted for rotation on rollers 30 and 32. The rollers 30 are mounted on a drive shaft 34 having a drive gear 98 mounted thereon and the rollers 32 are mounted on an idler shaft 36. The envelopes 5 are initially aligned on the belt 28 by means of a stop plate 38 mounted along one side of the conveyor assembly 29 in a position to stop the envelopes as they are dropped off of the plate 18. The envelopes are aligned into an even stack by means of a pusher plate 40 which is mounted on the end of the belts 28.

In this regard, the pusher plate 40 is supported on the housing 15 by means of a pair of rods 42 mounted in bushings 44 and extending through the side wall 17 of the housing 15. The pusher plate 40 is biased into engagement with the end of the bushings 44 by means of a pair of springs 46 mounted on the rods 42 and held thereon by means of a nut 48 and a washer 50 mounted on the end of the rod 42. The pusher plate 40 is moved with the conveyor belts 28 by means of a rod or pin 54 mounted between a pair of plates 56 secured to the drive shaft 34. The pin 54 is located in a position to engage a tab 58 provided on the lower edge of the pusher plate 40. On rotation of the drive shaft 34, the pin 54 will push the pusher plate 40 against the envelopes 5 stacked on the belts 28 so that the envelopes move at the same speed as the belts 28. This will prevent any misalignment of the envelopes on the initial movement of the belts 28.

The stack of envelopes 5 are moved onto the transfer conveyor assembly 16 which carries the envelopes to a strapping or bundling station. The transfer conveyor assembly 16 includes a pair of rollers 62 and 64, having a pair of belts 60 trained around them. The rollers 62 are mounted on a drive shaft 66 having a drive gear 84 mounted on one end and rollers 64 are mounted on an idler shaft 68.

The in-feed conveyor assembly 20 and the transfer conveyor assembly 16 are driven by means of a motor 70 mounted on the sidewall 17 of housing 15 and having a drive pulley 71 mounted thereon. The transfer conveyor assembly is driven by means of a gear set 80 which includes a drive gear 82 mounted on the end of a shaft 78 and driven gear 84 mounted on the shaft 66. A pulley 76 is mounted on the shaft 78. The drive gear 82 has a smaller diameter than the driven gear 84. The motor 70 is connected to drive the in-feed conveyor assembly 20 and the transfer conveyor assembly 16 by means of a drive belt 86 which is mounted on pulleys 71, 74 and 76. With this arrangement, the in-feed conveyor assembly is driven at the same speed as the motor 70 and the transfer conveyor assembly is driven at a lower speed determined by the ratio of the beveled gears 82 and 84 in the gear set 80.

Means are provided for intermittently activating the stacking assembly 14. Such means is in the form of a one-revolution clutch 90 mounted on one end of a shaft 92. The shaft 92 is connected to the shaft 34 by means of a second gear set 94 provided on the end of the shaft 92. Gear set 94 includes a drive gear 98 mounted on shaft 34 and a driven gear 96 mounted on the end of shaft 92. The one-way clutch 90 is driven by means of a pulley 102 mounted on the shaft 78. The pulley 100 is mounted to rotate freely on the shaft 92 and driven by means of a belt 104 mounted on the pulley 100 and a pulley 102 mounted on shaft 78. The motion of the pulley 100 being transferred to the shaft 92 on actuation of the one-revolution clutch 90 as described hereinafter.

Figure 5:
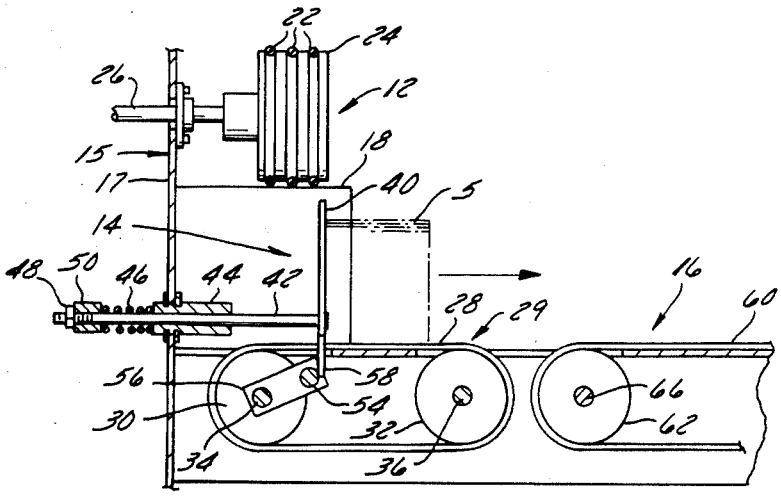
FIG. 5 is a view similar to FIG. 4 showing the pusher plate in the eject position in the stacking assembly.

In this regard the one-revolution clutch 90 is operatively connected to a sensing mechanism 104 mounted on the housing in close proximity to the in-feed conveyor assembly 12. The sensing mechanism can be in the form of a counter 106 which can be set to trip the clutch 90 whenever the required number of envelopes has passed the counter 106. A scanner can also be mounted on the housing to scan zip codes on the envelopes and trip the clutch 90 when a new zip code series is fed to the stacking apparatus. The counter can be in the form of an electric eye positioned to count the envelopes as they are moved across the plate 18 by the in-feed conveyor 20. The counter can then be set to stack as many envelopes as desired in the stacking assembly 14. If the stacking apparatus is to be used to differentiate between zip code numbers, an optical character reader can be provided to sense the zip codes marked on the envelopes and to both control the number of envelopes in each stack and to activate the stack assembly when the zip code numbers change. On activation of the one-way clutch 90, the shaft 92 will be rotated one revolution which, through the gear set 94, will advance the conveyor belts 28 far enough to move envelopes to the discharge conveyor. On rotation of the shaft 34, the pin 54 will move the pusher plate 40 with the conveyor to hold the stacked envelopes in a stack relation as they are moved to the transfer conveyor. When the pin 54 clears the tab 58, as seen in FIG. 5, the springs 46 will return the pusher to its initial position ready to align the next stack of envelopes.

The embodiments of the invention in which an exclusive property of privilege is claimed, are defined as follows:

1. In an envelope stuffing machine of the type including a transfer conveyor on which insert stacks are formed by the step-by-step motion of the transfer conveyor, the inserts are fed from insert feed bins located at feed stations along the transfer converyor, the insert stacks being carried to a stuffing station of the type including a stuffing mechanism for opening envelopes fed to the station from feed bins and for stuffing the insert stacks into the envelope and a discharge conveyor for conveying the stuffed envelopes from the stuffing station, the improvement comprising an envelope stacking apparatus positioned to receive stuffed envelopes from the discharge conveyor, said apparatus including first means for transferring the stuffed envelopes from the discharge conveyor to the stacking apparatus, second means for receiving and stacking the envelopes, said second means including a stacking conveyor for receiving the stuffed envelopes, a pusher plate and means for supporting said pusher plate on the end of said stacking conveyer receiving said envelopes, releaseable drive means on said stacking conveyor for initially moving said pusher plate with and at the same speed as said conveyor to maintain the alignment of the envelopes on actuation of said stacking conveyor, said supporting means including means for biasing said pusher plate to said receiving end of the stacking conveyor to return said pusher to said end on release from said drive means, and third means for transporting the stacked envelopes from said stacking means.

2. The stacking apparatus according to claim 1 wherein said first means includes a sensing means for actuating said second means when the predetermined number of envelopes has been transferred to the stacking assembly.

3. The stacking apparatus according to claim 1 including a drive means operably connected to continously drive said first and third means and a one revolution clutch connected to drive said stacking conveyor for said second means, said clutch being connected to said drive means, and said sensing means being operably connected to said clutch whereby said conveyor assembly will be activated when a predetermined number of envelopes have been fed to the stacking means.

4. An envelope stacking apparatus for stacking envelopes discharge from a step-by-step envelope insertion machine, said apparatus comprising, a housing;

in feed conveyor means for transferring stuffed envelopes from the insertion machine to the stacking apparatus;

stacking means for stacking envelopes as the envelopes are transferred by said first conveyor means to the stacking means;

said stacking means including a stacker plate positioned to engage and align the front edge of the envelopes as the envelopes are transferred to the stacking means, a pusher plate positioned transverse to said stacking plate to align one side of the envelopes, means for supporting said pusher plate for movement across the front of the stacker plate, said supporting means including spring means for biasing the pusher plate to the stacking position, and a stacking conveyor positioned perpendicular to the direction of motion of said in feed conveyor means, said stacking conveyor including releaseable means for initially moving said pusher plate with and at the same speed as said stacking conveyor, said pusher plate returning to said stacking position on releasse from said moving means;

transfer conveyor means for transporting envelopes stacked by said stacking means from the stacking apparatus; and and a drive means for intermittently actuating said stacking conveyor, said drive means including a one-revolution clutch operatively connected to said stacking conveyor to advance the stacked envelopes a distance sufficient to move the envelopes into said transfer conveyor in one revolution of said clutch, sensing means for actuating said clutch means when a predetermined number of envelopes have been transferred to said stacking means.

* * * * *